United States Patent [19]

Bissot et al.

[11] 4,437,951

[45] Mar. 20, 1984

[54] MEMBRANE, ELECTROCHEMICAL CELL, AND ELECTROLYSIS PROCESS

[75] Inventors: Thomas C. Bissot, Newark, Del.; Walter G. Grot, Chadds Ford, Pa.; Paul R. Resnick, Wilmington, Del.

[73] Assignee: E. I. Du Pont de Nemours & Co., Wilmington, Del.

[21] Appl. No.: 451,991

[22] Filed: Dec. 21, 1982

Related U.S. Application Data

[63] Continuation-in-part of Ser. No. 330,606, Dec. 15, 1981, abandoned, which is a continuation-in-part of Ser. No. 319,991, Nov. 12, 1981, abandoned, which is a continuation-in-part of Ser. No. 225,641, Jan. 16, 1981, abandoned.

[51] Int. Cl.[3] ..... C25B 1/34; C25B 13/04; C25B 13/08

[52] U.S. Cl. ..... 204/98; 204/128; 204/263; 204/266; 204/283; 204/296

[58] Field of Search ..... 204/98, 128, 296, 283, 204/263, 266

[56] References Cited

U.S. PATENT DOCUMENTS

| | | | |
|---|---|---|---|
| 3,940,916 | 3/1976 | Grot | 57/140 R |
| 4,021,327 | 5/1977 | Grot | 204/98 |
| 4,065,366 | 12/1977 | Oda | 204/296 |
| 4,135,996 | 1/1979 | Bouy et al. | 204/98 |
| 4,170,537 | 10/1979 | Simmons | 204/295 |
| 4,170,538 | 10/1979 | Simmons | 204/295 |
| 4,170,539 | 10/1979 | Simmons | 204/295 |
| 4,176,215 | 11/1979 | Molnar et al. | 521/27 |
| 4,178,218 | 12/1979 | Seno | 204/98 |
| 4,191,618 | 3/1980 | Coher et al. | 204/98 |
| 4,272,337 | 6/1981 | Darlington | 204/98 |

FOREIGN PATENT DOCUMENTS

| | | |
|---|---|---|
| 51-71888 | 6/1976 | Japan . |
| 51-99694 | 9/1976 | Japan . |
| 52-140498 | 11/1977 | Japan . |
| 52-144388 | 12/1977 | Japan . |
| 52-156789 | 12/1977 | Japan . |
| 53-56192 | 5/1978 | Japan . |
| 53-108888 | 9/1978 | Japan . |
| 53-149881 | 12/1978 | Japan . |
| 54-1283 | 1/1979 | Japan . |
| 54-107479 | 8/1979 | Japan . |
| 55-50480 | 4/1980 | Japan . |
| 1295874 | 11/1972 | United Kingdom . |
| 2040222 | 8/1980 | United Kingdom . |
| 2040803 | 9/1980 | United Kingdom . |

OTHER PUBLICATIONS

Grot, Use of Nafion® Membranes as a Separator in Electrolytic Cells, German Chemical Society, Electrochemistry Div. 10/6–7/77.

*Primary Examiner*—R. L. Andrews

[57] ABSTRACT

An ion exchange membrane which comprises a layer of fluorinated polymer which has carboxylic functional groups, a second layer of fluorinated polymer which has sulfonic or carboxylic functional groups at a surface layer, and a web of support material therein, and which has channels in the membrane which extend from window areas of the membrane to blind areas of the membrane occluded by members of the support material, is described. Precursor membrane which contains both reinforcement members and sacrificial members, and from which the ion exchange membrane is made, is also described. The ion exchange membrane can be used to separate the compartments of a chloralkali cell, and such a cell operates at low voltage, high current efficiency, and low power consumption.

82 Claims, No Drawings

MEMBRANE, ELECTROCHEMICAL CELL, AND ELECTROLYSIS PROCESS

CROSS-REFERENCE TO RELATED APPLICATION

This application is a continuation-in-part of prior copending application U.S. Ser. No. 330,606 filed Dec. 15, 1981, now abandoned, which is a continuation-in-part of U.S. Ser. No. 319,991 filed Nov. 12, 1981, now abandoned, which is in turn a continuation-in-part of U.S. Ser. No. 225,641 filed Jan. 16, 1981, now abandoned.

BACKGROUND OF THE INVENTION

Fluorinated ion exchange polymers having carboxylic acid and/or sulfonic acid functional groups or salts thereof are known in the art. One principal use of such polymers is as a component of a membrane used to separate the anode and cathode compartments of a chloralkali electrolysis cell. Such membrane can be in the form of a reinforced or unreinforced film or laminar structure.

It is desirable for use in a chloralkali cell that a membrane provides for operation at low voltage and high current efficiency, and thereby at low power consumption, so as to provide products of high purity at low cost, especially in view of today's steadily increasing cost of energy. It is also desirable that the membrane be tough, so as to resist damage during fabrication and installation in such a cell. As films of the best available ion exchange polymers have low tear strength, it has been found necessary to strengthen them by fabricating membranes with reinforcement therein, such as a reinforcing fabric.

However, use of reinforcement within the membrane is not totally beneficial. One deleterious effect is that use of reinforcement such as fabric results in a thicker membrane, which in turn leads to operation at higher voltage because the greater thickness has a higher electrical resistance. Efforts to lower the resistance by using thinner films in fabricating reinforced membranes are often unsuccessful because the film ruptures in some of the windows of the fabric during membrane fabrication, resulting in a membrane with leaks. (By "windows" is meant the open areas of a fabric between adjacent threads of the fabric.) A membrane which leaks is undesirable as it permits anolyte and catholyte to flow into the opposite cell compartment, thereby lowering the current efficiency and contaminating the products made. Additionally, thick layers of polymer at the junctions of threads in a reinforcing fabric also constitute regions of high resistance. (By "junctions" is meant the crossover points where threads in the warp meet threads in the weft.)

A second deleterious effect, which also leads to operation at higher voltage, is caused by a "shadowing" effect of the reinforcing members. The shortest path for an ion through a membrane is a straight perpendicular path from one surface to the other surface. Reinforcement members are uniformly fabricated of substance which is not ion-permeable. Those parts of a membrane where an ion cannot travel perpendicularly straight through the membrane, and from which the ion must take a circuitous path around a reinforcng member, are termed "shadowed areas". Introduction of shadowed areas into a membrane by use of reinforcement in effect leads to a reduction in the portion of the membrane which actively transports ions, and thus increases the operating voltage of the membrane. That part of the shadowed area of a membrane which is adjacent the downstream side of the reinforcement members, "downstream" referring to the direction of the positive ion flux through the membrane, is termed the "blind area".

It is a principal object of this invention to provide an ion exchange membrane which operates at low voltage and high current efficiency, and thereby at low power consumption, and yet has good tear resistance. Another object is to provide a thin, tough ion exchange membrane. Other objects will be apparent hereinbelow.

SUMMARY OF THE INVENTION

Briefly, according to the present invention, there is provided an ion exchange membrane having reinforcement members which have a high aspect ratio as defined hereinbelow, a layer of polymer which has carboxylic functionality on the downstream side of the reinforcement members, and channels in the membrane which lead to the blind area.

More specifically there is provided an ion exchange membrane which is impermeable to hydraulic flow of liquid, which comprises at least two layers of fluorinated polymer having —COOM or —$SO_3M$ functional groups, where M is H, Na, K or $NH_4$, adjacent said layers being in adherent contact with one another, and a web of support material embedded therein, there being at least a first said layer of polymer whose functional groups are —COOM functional groups and a second said layer of polymer whose functional groups are —COOM or —$SO_3M$ functional groups, each said polymer with —COOM groups having an equivalent weight of 770 to 1250, and any said polymer with —$SO_3M$ groups having an equivalent weight of 900 to 1400, the total thickness of said at least two layers of fluorinated polymer, as measured on the layers of precursor polymer having —COOR or —$SO_2W$ functional groups where R is lower alkyl and W is F or Cl used in preparation of said membrane, being in the range of 50 to 250 microns, said web of support material having a thickness of about 25 to 125 microns and an openness of at least 50% and consisting of reinforcing members, said reinforcing members defining window areas therebetween, and channels in said membrane extending from said window areas to blind areas where said reinforcing members are proximate to said first layer. Preferably the functional groups of the second said layer are —$SO_3M$.

There are also provided according to the invention a precursor membrane from which the ion exchange membrane is made, an electrochemical cell having said ion exchange membrane as a component part thereof, and an electrolysis process in which said ion exchange membrane is used.

DETAILED DESCRIPTION OF THE INVENTION

The membranes of the present invention are typically prepared from two or more layers of fluorinated polymer which have —COOR or —$SO_2W$ functional groups, where R is lower alkyl and W is F or Cl, and a web of support material.

The first layer of polymer with which the present invention is concerned is typically a carboxylic polymer having a fluorinated hydrocarbon backbone chain to which are attached the functional groups or pendant side chains which in turn carry the functional groups. The pendant side chains can contain, for example $$-\left(\underset{\underset{Z}{|}}{CF}\right)_t-V$$

groups wherein Z is F or $CF_3$, t is 1 to 12, preferably 1 to 4, and V is —COOR or —CN, where R is lower alkyl. Especially preferred values of t are 2 and 3, as polymers where t has those values are readily prepared. Ordinarily, the functional group in the side chains of the polymer will be present in terminal $$-O-\left(\underset{\underset{Z}{|}}{CF}\right)_t-V$$

groups. Values and preferred values of t are as stated above. Examples of fluorinated polymers of this paragraph are disclosed in British Pat. No. 1,145,445, U.S. Pat. Nos. 4,116,888 and 3,506,635. More specifically, the polymers can be prepared from monomers which are fluorinated or fluorine-substituted vinyl compounds. The polymers are usually made from at least two monomers. At least one monomer is a fluorinated vinyl compound such as vinyl fluoride, hexafluoropropylene, vinylidene fluoride, trifluoroethylene, chlorotrifluoroethylene, perfluoro(alkyl vinyl ether), tetrafluoroethylene and mixtures thereof. In the case of copolymers which will be used in electrolysis of brine, the precursor vinyl monomer desirably will not contain hydrogen. Additionally, at least one monomer is a fluorinated monomer which contains a group which can be hydrolyzed to a carboxylic acid group, e.g., a carboalkoxy or nitrile group, in a side chain as set forth above.

By "fluorinated polymer" is meant a polymer which is highly fluorinated, but in which some C—H and C—Cl groups may be present, and in which, after loss of the R group by hydrolysis to ion exchange form, the number of F atoms is at least 90% of the number of F atoms and H and/or Cl atoms.

The monomers, with the exception of the R group in the —COOR, will preferably not contain hydrogen, especially if the polymer will be used in the electrolysis of brine, and for greatest stability in harsh environments, most preferably will be free of both hydrogen and chlorine, i.e., will be perfluorinated; the R group need not be fluorinated as it is lost during hydrolysis when the functional groups are converted to ion exchange groups.

One exemplary suitable type of carboxyl-containing monomer is represented by the formula $$CF_2{=}CF\left(OCF_2\underset{\underset{Y}{|}}{CF}\right)_sOCF_2{-}COOR$$

wherein

R is lower alkyl,

Y is F or $CF_3$, and s is 0, 1 or 2.

Those monomers wherein s is 1 are preferred because their preparation and isolation in good yield is more easily accomplished than when s is 0 or 2. The compound $$CF_2{=}CFOCF_2\underset{\underset{CF_3}{|}}{C}FOCF_2COOCH_3$$

is a useful monomer. Such monomers can be prepared, for example, from compounds having the formula $$CF_2{=}CF(OCF_2\underset{\underset{Y}{|}}{C}F)_sOCF_2CF_2SO_2F$$

wherein s and Y are as defined above, by (1) saturating the terminal vinyl group with chlorine to protect it in subsequent steps by converting it to a $CF_2Cl$—CFCl— group; (2) oxidation with nitrogen dioxide to convert the $-OCF_2CF_2SO_2F$ group to an $-OCF_2COF$ group; (3) esterification with an alcohol such as methanol to form an $-OCF_2COOCH_3$ group; and (4) dechlorination with zinc dust to regenerate the terminal $CF_2{=}CF$— group. It is also possible to replace steps (2) and (3) of this sequence by the steps (a) reduction of the $-OCF_2CF_2SO_2F$ group to a sulfinic acid, $-OCF_2CF_2SO_2H$, or alkali metal or alkaline earth metal salt thereof by treatment with a sulfite salt or hydrazine; (b) oxidation of the sulfinic acid or salt thereof with oxygen or chromic acid, whereby $-OCF_2COOH$ groups or metal salts thereof are formed; and (c) esterification to $-OCF_2COOCH_3$ by known methods; this sequence, together with preparation of copolymers of such monomer, is more fully described in U.S. Pat. No. 4,267,364.

Another exemplary suitable type of carboxyl-containing monomer is represented by the formula $$CF_2{=}CF\left(OCF_2\underset{\underset{Y}{|}}{CF}\right)_sOCF_2{-}\underset{\underset{Z}{|}}{CF}{-}V$$

wherein

V is —COOR or —CN,

R is lower alkyl,

Y is F or $CF_3$,

Z is F or $CF_3$, and s is 0, 1 or 2.

The most preferred monomers are those wherein V is —COOR wherein R is lower alkyl, generally $C_1$ to $C_5$, because of ease in polymerization and conversion to ionic form. Those monomers wherein s is 1 are also preferred because their preparation and isolation in good yield is more easily accomplished than when s is 0 or 2. Preparation of those monomers wherein V is —COOR where R is lower alkyl, and copolymers thereof, is described in U.S. Pat. No. 4,131,740. The compounds $$CF_2{=}CFOCF_2\underset{\underset{CF_3}{|}}{C}FOCF_2CF_2COOCH_3,\text{ and}$$

$$CF_2{=}CFO(CF_2\underset{\underset{CF_3}{|}}{C}FO)_2CF_2CF_2COOCH_3,$$

whose preparation is described therein, are especially useful monomers. Preparation of monomers wherein V is —CN is described in U.S. Patent No. 3,852,326.

Yet another suitable type of carboxyl-containing monomer is that having a terminal $-O(CF_2)_vCOOCH_3$ group where v is from 2 to 12, such as $CF_2=CF-O(CF_2)_3COOCH_3$ and $CF_2=CFOCF_2CF(CF_3)O(CF_2)_3COOCH_3$. Preparation of such monomers and copolymers thereof is described in Japanese Patent Publications 38486/77 and 28586/77, and in British Patent No. 1,145,445.

Another class of carboxyl-containing polymers is represented by polymers having the repeating units

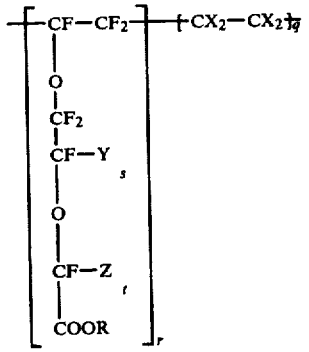

wherein q is 3 to 15, r is 1 to 10, s is 0, 1 or 2, t is 1 to 12, the X's taken together are four fluorines or three fluorines and one chlorine, Y is F or $CF_3$, Z is F or $CF_3$, and R is lower alkyl.

A preferred group of copolymers are those of tetrafluoroethylene and a compound having the formula $$CF_2=CFO(CF_2\underset{\underset{Y}{|}}{C}FO)_n(CF_2)_mCOOR,$$

where n is 0, 1 or 2, m is 1, 2, 3 or 4,

Y is F or $CF_3$, and

R is $CH_3$, $C_2H_5$ or $C_3H_7$.

Such copolymers with which the present invention is concerned can be prepared by techniques known in the art, e.g., U.S. Pat. No. 3,528,954, U.S. Pat. No. 4,131,740, and South African Patent No. 78/2225.

The sulfonyl polymer with which the present invention is concerned is typically a polymer having a fluorinated hydrocarbon backbone chain to which are attached the functional groups or pendant side chains which in turn carry the functional groups. The pendant side chains can contain, for example, $$-CF_2-\underset{\underset{R_f}{|}}{C}F-SO_2W$$

groups wherein $R_f$ is F, Cl, or a $C_1$ to $C_{10}$ perfluoroalkyl radical, and W is F or Cl, preferably F. Ordinarily, the functional group in the side chains of the polymer will be present in terminal $$-O-CF_2-\underset{\underset{R_f}{|}}{C}F-SO_2F$$

groups. Examples of fluorinated polymers of this kind are disclosed in U.S. Pat. No. 3,282,875, U.S. Pat. No. 3,560,568 and U.S. Pat. No. 3,718,627. More specifically, the polymers can be prepared from monomers which are fluorinated or fluorine substituted vinyl compounds. The polymers are made from at least two monomers, with at least one of the monomers coming from each of the two groups described below.

At least one monomer is a fluorinated vinyl compound such as vinyl fluoride, hexafluoropropylene, vinylidene fluoride, trifluoroethylene, chlorotrifluoroethylene, perfluoro(alkyl vinyl ether), tetrafluoroethylene and mixtures thereof. In the case of copolymers which will be used in electrolysis of brine, the precursor vinyl monomer desirably will not contain hydrogen.

The second group is the sulfonyl-containing monomers containing the precursor group $$-CF_2-\underset{\underset{R_f}{|}}{C}F-SO_2F,$$

wherein $R_f$ is as defined above. Additional examples can be represented by the general formula $CF_2=CF-T_k-CF_2SO_2F$ wherein T is a bifunctional fluorinated radical comprising 1 to 8 carbon atoms, and k is 0 or 1. Substituent atoms in T include fluorine, chlorine, or hydrogen, although generally hydrogen will be excluded in use of the copolymer for ion exchange in a chloralkali cell. The most preferred polymers are free of both hydrogen and chlorine attached to carbon, i.e., they are perfluorinated, for greatest stability in harsh environments. The T radical of the formula above can be either branched or unbranched, i.e., straight-chain, and can have one or more ether linkages. It is preferred that the vinyl radical in this group of sulfonyl fluoride containing comonomers be joined to the T group through an ether linkage, i.e., that the comonomer be of the formula $CF_2=CF-O-T-CF_2-SO_2F$. Illustrative of such sulfonyl fluoride containing comonomers are $$CF_2=CFOCF_2CF_2SO_2F,\ CF=CFOCF_2\underset{\underset{CF_3}{|}}{C}FOCF_2CF_2SO_2F,$$

$$CF_2=CFOCF_2\underset{\underset{CF_3}{|}}{C}FOCF_2\underset{\underset{CF_3}{|}}{C}FOCF_2CF_2SO_2F,$$

$$CF=CFCF_2CF_2SO_2F,\ \text{and}\ CF_2=CFOCF_2\underset{\underset{\underset{\underset{CF_3}{|}}{O}}{\underset{CF_2}{|}}}{C}FOCF_2CF_2SO_2F.$$

The most preferred sulfonyl fluoride containing comonomer is perfluoro(3,6-dioxa-4-methyl-7-octenesulfonyl fluoride), $$CF_2=CFOCF_2\underset{\underset{CF_3}{|}}{C}FOCF_2CF_2SO_2F.$$

The sulfonyl-containing monomers are disclosed in such references as U.S. Pat. No. 3,282,875, U.S. Pat. No. 3,041,317, U.S. Pat. No. 3,718,627 and U.S. Pat. No. 3,560,568.

A preferred class of such polymers is represented by polymers having the repeating units

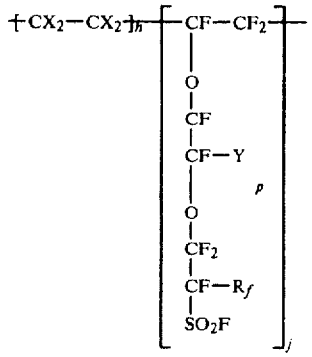

wherein h is 3 to 15, j is 1 to 10, p is 0, 1 or 2, the X's taken together are four fluorines or three fluorines and one chlorine, Y is F or $CF_3$, and $R_f$ is F, Cl or a $C_1$ to $C_{10}$ perfluoroalkyl radical.

A most preferred copolymer is a copolymer of tetrafluoroethylene and perfluoro(3,6-dioxa-4-methyl-7-octenesulfonyl fluoride) which comprises 20 to 65 percent, preferably, 25 to 50 percent by weight of the latter.

Such copolymers used in the present invention can be prepared by general polymerization techniques developed for homo- and copolymerizations of fluorinated ethylenes, particularly those employed for tetrafluoroethylene which are described in the literature. Nonaqueous techniques for preparing the copolymers include that of U.S. Pat. No. 3,041,317, that is, by the polymerization of a mixture of the major monomer therein, such as tetrafluoroethylene, and a fluorinated ethylene containing a sulfonyl fluoride group in the presence of a free radical initiator, preferably a perfluorocarbon peroxide or azo compound, at a temperature in the range 0°–200° C. and at pressures in the range of $10^5$ to $2\times10^7$ pascals (1–200 Atm.) or higher. The nonaqueous polymerization may, if desired, be carried out in the presence of a fluorinated solvent. Suitable fluorinated solvents are inert, liquid, perfluorinated hydrocarbons, such as perfluoromethylcyclohexane, perfluorodimethylcyclobutane, perfluorooctane, perfluorobenzene and the like, and inert, liquid chlorofluorocarbons such as 1,1,2-trichloro-1,2-2-trifluoroethane, and the like.

Aqueous techniques for preparing the copolymer include contacting the monomers with an aqueous medium containing a free-radical initiator to obtain a slurry of polymer particles in non-water-wet or granular form, as disclosed in U.S. Pat. No. 2,393,967, or contacting the monomers with an aqueous medium containing both a free-radical initiator and a telogenically inactive dispersing agent, to obtain an aqueous colloidal dispersion of polymer particles, and coagulating the dispersion, as disclosed, for example, in U.S. Pat. No. 2,559,752 and U.S. Pat. No. 2,593,583.

It is additionally possible to use a laminar film as one of the component films in making the membrane. For example, a film having a layer of a copolymer having sulfonyl groups in melt-fabricable form and a layer of a copolymer having carboxyl groups in melt-fabricable form, can also be used as one of the component films in making the membrane of the invention.

When used in a film or membrane to separate the anode and cathode compartments of an electrolysis cell, such as a chloralkali cell, the sulfonate polymers dealt with herein, after conversion to ionizable form, should have a total ion exchange capacity of 0.5 to 2 meq/g (milliequivalents/gram), preferably at least 0.6 meq/g, and more preferably from 0.8 to 1.4 meq/g. Below an ion exchange capacity of 0.5 meq/g, the electrical resistivity becomes too high, and above 2 meq/g the mechanical and electrochemical properties are poor because of excessive swelling of the polymer. The relative amounts of the comonomers which make up the polymer should be adjusted or chosen such that the polymer has an equivalent weight no greater than about 2000, preferably no greater than about 1400, for use as an ion exchange barrier in an electrolytic cell. The equivalent weight above which the resistance of a film or membrane becomes too high for practical use in an electrolytic cell varies somewhat with the thickness of the film or membrane. For thinner films and membranes, equivalent weights up to about 2000 can be tolerated. Ordinarily, the equivalent weight will be at least 600, and preferably will be at least 900. Film of polymer having sulfonyl groups in ion exchange form preferably will have an equivalent weight in the range of 900 to 1500. For most purposes, however, and for films of ordinary thickness, a value no greater than about 1400 is preferred.

For the carboxylate polymers dealt with herein, when used to separate the compartments of a chloralkali cell, the requirements in respect to the ion exchange capacity thereof differ from those of the sulfonate polymers. The carboxylate polymer must have an ion exchange capacity of at least 0.6 meq/g, preferably at least 0.7 meq/g, and most preferably at least 0.8 meq/g, so as to have acceptably low resistance. Such values are especially applicable in the case of films having a thickness in the lower end of the specified thickness range of 10 to 100 microns; for films in the middle and upper end of this range, the ion exchange capacity should be at least 0.7 meq/g and preferably at least 0.8 meq/g. The ion exchange capacity should be no greater than 2 meq/g, preferably no greater than 1.5 meq/g, and more preferably no greater than 1.3 meq/g. In terms of equivalent weight, the carboxylate polymer most preferably has an equivalent weight in the range of 770 to 1250.

The membranes of the invention are prepared from component polymer films which have a thickness ranging from as low as about 13 microns (0.5 mil) up to about 150 microns (6 mils). As the membrane will generally be prepared from two or three such polymer films, the total thickness of polymer films used in making the resulting membrane will generally lie in the range of about 50 to 250 microns (2 to 10 mils), preferably 75 to 200 microns (3 to 8 mils), most preferably about 75 to 150 microns (3 to 6 mils).

The customary way to specify the structural composition of membranes in this field of art is to specify the polymer composition, equivalent weight and thickness of the polymer films in melt-fabricable form, and the type of reinforcing fabric, from which the membrane is fabricated. This is done, in the case of both the immediate product membrane of the lamination procedure and the hydrolyzed ion-exchange membrane made therefrom, because (1) the thickness of a reinforced membrane is not uniform, being thicker at the cross-over points of the reinforcing fabric and thinner elsewhere, and measurement made by calipers or micrometer indicates only the maximum thickness, and (2) measurement by cross-sectioning, making a photomicrograph, and measuring on the photograph is laborious and time-consuming. Furthermore, in the case of the hydrolyzed ion-exchange membrane, the measured thickness varies depending on whether the membrane is dry or swollen with water or an electrolyte, and even on the ionic species and ionic strength of the electrolyte, even though the amount of polymer remains constant. As the membrane performance is in part a function of the amount of polymer, the most convenient way to specify structural composition is as stated immediately above.

The web of support material is suitably a woven fabric or a nonwoven paper. In either case, the web consists of both reinforcement members and sacrificial members.

In the case of woven fabric, weaves such as plain weaves, ordinary basketweave and leno weave are suitable. Both the reinforcement threads and sacrificial threads can be either monofilament or multistranded.

The reinforcement members are perhalocarbon polymer threads. As employed herein, the term "perhalocarbon polymer" is employed to refer to a polymer which has a carbon chain which may or may not contain ether oxygen linkages therein and which is totally substituted by fluorine or by fluorine and chlorine atoms. Preferably the perhalocarbon polymer is a perfluorocarbon polymer, as it has greater chemical inertness. Typical such polymers include homopolymers made from tetrafluoroethylene and copolymers of tetrafluoroethylene with hexafluoropropylene and/or perfluoro(alkyl vinyl ethers) with alkyl being 1 to 10 carbon atoms such as perfluoro(propyl vinyl ether). An example of a most preferred reinforcement material is polytetrafluoroethylene. Reinforcement threads made from chlorotrifluoroethylene polymers are also useful.

So as to have adequate strength in the fabric before lamination, and in the membrane after lamination, the reinforcement threads should be of 50 to 600 denier, preferably 100 to 300 denier (denier is g/9000 m of thread). However, threads of such denier having a typical, round cross section, give membranes which are less satisfactory because they are too thick, especially at the thread junctions where the crossover of the threads thickens the reinforcing to twice the thread thickness, thereby requiring use of layers of fluorinated polymer film of adequate thickness to preclude leaks; the overall effect is a thickness which results in operation at relatively high voltage. In accordance with the preferred mode of the invention, fabric whose reinforcement members have the specified denier, but which also have a cross-sectional shape which is noncircular and which has an aspect ratio in the range of 2 to 20, preferably in the range of 4 to 10, are used. By aspect ratio is meant the ratio of the width of the reinforcement member to its thickness. Typical suitable cross-sectional shapes include rectangular, oval, and elliptical. Rectangular members can be in the form of thin narrow ribbon slit or slit and drawn from film, or can be extruded, in which case the corners may be rounded. Oval, elliptical, and other shapes can be extruded or made by calendering fiber or yarn. It is also possible to calender a fabric to provide the required aspect ratio. A rectangular cross section as described above is preferred. As the web of support material should have a thickness in the range of 25 to 125 microns (1 to 5 mils), preferably 50 to 75 microns (2 to 3 mils), the reinforcing members should have a thickness of 12 to 63 microns (0.5 to 2.5 mils), preferably 25 to 38 microns (1 to 1.5 mils).

The fabric should have a thread count in the range of 1.6 to 16 reinforcement threads/cm (4 to 40 threads-/inch) in each of the warp and weft. A thread count in the range of 3 to 8 reinforcement threads/cm is preferred.

Suitable threads of PTFE having substantially rectangular cross-section can be made by lubricant-assisted PTFE sheet extrusion, slitting and stretching, or can be made by lubricant-assisted extrusion of flat PTFE filament and stretching, e.g., as described in U.S. Pat. No. 2,776,465.

The sacrificial members of the fabric are threads of any of a number of suitable substances, either natural or synthetic. Suitable substances include cotton, linen, silk, rayon, polyamides such as 6-6 nylon, polyesters such as polyethylene terephthalate, and acrylics such as polyacrylonitrile. The cellulosic and polyester substances are preferred. The primary requirement of the sacrificial fibers is their removal without a detrimental effect on the polymer matrix. With this proviso, the chemical makeup of the sacrificial fibers is not critical. In similar fashion the manner of removal of the sacrificial fibers is not critical as long as this removal does not interfere with the ion exchange capability of the final polymer in the cation permeable separator. For purposes of illustration, removal of sacrificial fibers of a cellulosic material such as rayon may be done with sodium hypochlorite. The sacrificial fibers are fibers which can be removed without a detrimental effect on either an intermediate polymer which is a precursor to a polymer possessing ion exchange sites or a polymer with ion exchange sites. The sacrificial fibers are removed from either polymer leaving voids without interfering with the ion exchange capability of the final polymer. The manner of removal of the sacrificial fibers should not affect the supporting fibers employed to reinforce the separator.

The sacrificial members, e.g., rayon or polyester threads or narrow ribbon slit from regenerated cellulose film, can suitably be of about 40 to 100 denier. They can have an aspect ratio in the range of 1 to 20, i.e., can have a rectangular, oval or elliptical cross section, or if of low enough denier, can be of aspect ratio 1, i.e., circular in cross section. As in the case of the reinforcement threads, the sacrificial threads should have a thickness of 12 to 63 microns, preferably 25 to 38 microns.

In each of the warp and weft, the ratio of sacrificial threads to reinforcement threads in the fabric should be in the range of 10:1 to 1:1. Preferred ratios of sacrificial to reinforcement fibers are in the range from 2:1 to 8:1, and the most preferred ratios are 4:1 and 8:1.

It is further preferred that there be an even number of sacrificial fibers for each reinforcement fiber. Although fabrics which have an odd number of sacrificial fibers for each reinforcement fiber can be used, they are not the preferred type. The reason for this preference can be seen by visualizing what happens in the case of a fabric of ordinary weave which has one sacrificial fiber for each reinforcement fiber: when the sacrificial fibers of the fabric are removed, the reinforcement fibers which remain are not in the configuration of a woven fabric; one set of fibers merely lies on the other, and while such is permissible under the invention, it is not preferred. It is, of course, possible in such cases to use special weaves which will remain woven after the sacrifical fibers are removed. So as to avoid the necessity for making such special weaves, fabrics which have an even number of sacrificial fibers for each reinforcement fiber are preferred.

The reinforcement fabric can be made such that the threads of high aspect ratio present are either twisted or not twisted, and if twisted, a suitable number of twists, so that a high aspect ratio is maintained, is up to about 12, preferably 2 to 12.

The reinforcement fabric should be such that, after later removal of the sacrificial threads, the fabric will have an openness of at least 50%, preferably at least 65%. By "openness" is meant the total area of the windows in relation to the overall area of the fabric, expressed as a percentage.

In the case of nonwoven paper, a thin, open sheet of suitable component fibers can be used.

The reinforcement members are perhalocarbon polymer fibers. As used herein in reference to nonwoven paper, the term "fibers" includes not only chopped fibers cut from filaments, but also fibrids and fibrils. Perhalocarbon has the same meaning as given above in reference to perhalocarbon polymer threads, and again is preferably perfluorocarbon. These fibers are of 5 to 10 denier, and have a length of 3 to 20 mm, preferably 5 to 10 mm.

The sacrificial members are fibers of a cellulosic or other material described above in reference to sacrifical threads. The characteristics of paper fibers can be defined by a standard test which specifies the "freeness" of the pulp, e.g., the "Canadian Standard Freeness" as defined by TAPPI Standard T227m-58. A suitable freeness value for the sacrificial members of a paper is in the range of 300 to 750 ml Canadian Standard. A preferred example is kraft fibers.

The paper is composed of 10 to 90% by weight of perhalocarbon fibers and 90 to 10% by weight of sacrificial fibers, and preferably is composed of 25 to 75% by weight perhalocarbon fibers and 75 to 25% by weight of sacrificial fibers.

The paper should have a basis weight of 25 to 125 $g/m^2$, preferably no greater than 50 $g/m^2$. As in the case of a woven fabric, the paper thickness should be in the range of 25 to 125 microns (1 to 5 mils), preferably 50 to 75 microns (2 to 3 mils), and have an openness, after removal of the sacrificial fibers, of at least 50%, preferably at least 65%.

The membrane can be made from the component layers of film and the web of support material with the aid of heat and pressure. Temperatures of about 200° C. to 300° C. are ordinarily required to fuse the polymer films employed into adherent contact with each other, so as to form a unitary membrane structure with the support material, and, when more than two films are used, to make adjacent sheets of film fuse together; the temperature required may be even above or below this range, however, and will depend on the specific polymer or polymers used. The choice of a suitable temperature in any specific case will be clear, inasmuch as too low a temperature will fail to effect an adequate degree of adherence of the films to the reinforcement members and to each other, and/or large voids will form between the films adjacent to the reinforcement members, and too high a temperature will cause excessive polymer flow leading to leaks and nonuniform polymer thickness. Pressures of as little as about $2\times10^4$ pascals, to pressures exceeding $10^7$ pascals can be used. One type of apparatus, which is suitable for batch operations, is a hydraulic press, which ordinarily will use a pressure in the range of $2\times10^5$ to $10^7$ pascals.

Apparatus suitable for continuous preparation of membrane, and which was employed in the examples unless otherwise specified, comprised a hollow roll with an internal heater and an internal vacuum source. The hollow roll contained a series of circumferential slots on its surface which allowed the internal vacuum source to draw component materials in the direction of the hollow roll. A curved stationary plate with a radiant heater faced the top surface of the hollow roll with a spacing of about 6 mm (¼ inch) between their two surfaces.

During a lamination run, porous release paper was used in contact with the hollow roll as a support material to prevent adherence of any component material to the roll surface and to allow vacuum to pull component materials in the direction of the hollow roll. Feed and takeoff means were provided for the component materials and product. In the feed means one idler roll of smaller diameter than the hollow roll was provided for release paper and component materials. The feed and takeoff means were positioned to allow component materials to pass around the hollow roll over a length of about 5/6 of its circumference. A further idler roll was provided for the release paper allowing its separation from the other materials. Takeoff means were provided for the release paper and the product membrane.

For use in ion exchange applications and in cells, for example a chloralkali cell for electrolysis of brine, the membrane should have all of the functional groups converted to ionizable functional groups. Ordinarily and preferably these will be sulfonic acid and carboxylic acid groups, or alkali metal salts thereof. Such conversion is ordinarily and conveniently accomplished by hydrolysis with acid or base, such that the various functional groups described above in relation to the melt-fabricable polymers are converted respectively to the free acids or the alkali metal salts thereof. Such hydrolysis can be carried out with an aqueous solution of a mineral acid or an alkali metal hydroxide. Base hydrolysis is preferred as it is faster and more complete. Use of hot solutions, such as near the boiling point of the solution, is preferred for rapid hydrolysis. The time required for hydrolysis increases with the thickness of the structure. It is also of advantage to include a water-miscible organic compound such as dimethylsulfoxide in the hydrolysis bath.

Removal of the sacrificial fibers from the membrane can variously be done before, during or after conversion of the original membrane in melt-fabricable form to the ion exchange membrane. It can be done during said conversion when the sacrificial members are of a material which is destroyed by the hydrolysis bath employed for said conversion; an example is hydrolysis of a nylon polymer by caustic. It can be done before said conversion, e.g., in the case of rayon sacrificial members by treatment with aqueous sodium hypochlorite before said conversion, in which case there is prepared a membrane wherein the sacrificial fibers have been removed and the functional groups of the polymer layers are still in —COOR and —$SO_2W$ form. Hydrolysis can also first be done, in which case, the functional groups are onverted to —COOH and —$SO_3H$ or salt thereof, in which case there is prepared a membrane in ion exchange form which still contains the sacrificial fibers; ne sacrificial fibers are subsequently removed, which, n the case of rayon or other cellulosic members, or olyester members, in a membrane used in a chloroalkli cell, can be done by action of hypochlorite ions ormed in the cell during electrolysis.

Removal of sacrificial members from a membrane eaves channels in the membrane at the sites originally ccupied by the sacrificial members. These channels xtend in general from the window areas to the shadowed or blind areas, where the reinforcing members are roximate to the layer of fluorinated polymer which has carboxylic functional groups.

The channels have a nominal diameter in the range of l to 50 microns. This nominal diameter is the same as hat of the sacrificial fiber, the removal of which results n formation of the channel. It is believed that the actual diameter of a channel can change, shrinking or collapsing when the membrane is dehydrated, and swelling when the membrane itself is swollen. Ordinarily the channels left by removal of sacrificial threads of a fabric are in the range of 10 to 50 microns in diameter, and by removal of sacrificial members from a paper are in the range of 1 to 20 microns in diameter.

The membranes of the invention are prepared so that the web of support material does not penetrate through the first layer of fluorinated polymer which has carboxyl functionality, but lies at least predominantly in another layer of fluorinated polymer which has carboxy or sulfonyl functionality, and preferably in the second layer of fluorinated polymer which has carboxylic or sulfonyl functionality, which second layer is ordinarily a surface layer of the membrane. As a result, the channels also lie at least predominantly in layers other than the first layer of polymer, and preferably in the second layer of polymer which has carboxylic or sulfonyl functionality. The channels of the ion exchange membrane formed by removal of the sacrificial members do not penetrate through the membrane from one surface to the opposing surface, and the membrane is therefore impermeable to hydraulic flow of liquid at the low pressures typical of those occurring in a chloralkali cell. (A diaphragm, which is porous, permits hydraulic flow of liquid therethrough with no change in composition, while an ion exchange membrane permits selective permeation by ions and permeation of liquid by diffusion, such that the material which penetrates the membrane differs in composition from the liquid in contact with the membrane.) It is an easy matter to determine whether there are or are not channels which penetrate through the membrane by a leak test with gas or liquid. The channels, however, may be open or closed, i.e., may or may not penetrate through said second layer of fluorinated polymer to the surface of the membrane, and in either case extend from window areas of the membrane to blind areas. It is preferred that channels in said second layer are open to the surface of the membrane, for such membrane performs at lower voltage than a membrane with closed channels. It is believed, in the case of use of the ion exchange membrane in electrolysis of brine, in which case the membrane is disposed with the layer having carboxylic functionality toward the catholyte and the second layer, preferably having sulfonic functionality, toward the anolyte (brine), that the channels, if open, serve to carry brine to blind areas within the membrane where the reinforcing members are proximate to the layer with carboxylic functionality, or, if closed, serve similarly to carry liquid which penetrates into the surface portion of said second layer to blind areas.

When the ratio of sacrificial threads to reinforcement threads of a fabric is 1:1, after removal of sacrificial threads, channels extend from a window area to blind areas adjacent half of the thread segments. By "thread segment" is meant that length of a reinforcement thread which extends from one thread junction to an adjacent thread junction. When the ratio of sacrificial threads to reinforcement threads is 2:1, after removal of sacrificial threads, channels extend from a window area to blind areas adjacent all the thread segments. As the ratio of sacrificial threads to reinforcement threads further increases, the number of subsequently formed channels to blind areas further increases. Accordingly, fabrics with sacrificial thread to reinforcement thread ratios of at least 2:1 are preferred.

With reference to the paper support materials, after removal of the sacrificial fibers, the part of the paper remaining in the membrane has a basis weight of 2.5 to 112.5 g/m$^2$, preferably no greater than 45 g/m$^2$. It is believed that the channels formed upon removal of the sacrificial fibers of a paper support material are interconnected.

A preferred membrane of the invention is that which consists of a first layer of fluorinated polymer having only —COOR functional groups as one surface layer, a second layer of fluorinated polymer having only —$SO_2F$ functional groups as the other surface layer, and a web of support material embedded in the second layer. Said first layer has a thickness in the range of about 25 to 75 microns, and said second layer has a thickness in the range of about 75 to 150 microns. After hydrolysis to the ion exchange form and removal of the sacrificial members of the support material, the resulting ion exchange membrane is a preferred membrane for a chloralkali cell. It is further preferred that the channels of this latter membrane be open channels as described above. It should be understood that while such membranes have two layers of fluorinated polymer, they are often fabricated from three or more layers of polymer, e.g., a layer of polymer having —COOR groups, a layer of polymer having —$SO_2W$ groups, a web of support material and another layer of polymer having —$SO_2W$ groups, in the indicated sequence, so that the web of support material will become embedded completely, or at least almost completely, in the matrix of polymer having —$SO_2W$ groups, as is shown in some of the examples to follow. In the appended claims, the thicknesses of component layers are nominal thicknesses, i.e., thicknesses of the layers used before combining them to make the membrane, while the overall thickness of a membrane refers to its thickness after preparation of the membrane.

A principal use of the ion exchange membrane of the invention is in electrochemical cells. Such a cell comprises an anode, a compartment for the anode, a cathode, a compartment for the cathode, and a membrane which is situated to separate the two said compartments. One example is a chloralkali cell, for which the membrane should have the functional groups in salt form; in such a cell, a layer of the membrane which has carboxylic functional groups will be disposed toward the cathode compartment.

The electrochemical cell, especially a chloralkali cell, will ordinarily be constructed such that the gap or spacing between the anode and cathode is narrow, i.e., no greater than about 3 mm. It is also often advantageous to operate the cell and electrolysis process with the membrane in contact with either the anode or cathode, which can be accomplished with the aid of an appropriate hydraulic head in one cell compartment, or by using an open mesh or grid separator to urge the membrane and selected electrode into contact. It is often further advantageous for the membrane to be in contact with both the anode and cathode in an arrangement referred to as a zero-gap configuration. Such arrangements offer advantages in minimizing the resistance contributed by the anolyte and catholyte, and thus provide for operation at low voltage. Whether or not such arrangements are used, either or both electrodes can have an appropriate catalytically active surface layer of type known in the art for lowering the overvoltage at an electrode.

The membranes described herein can be used as a substrate to carry an electrocatalyst composition on either surface or both surfaces thereof, the resulting article being a composite membrane/electrode.

Such electrocatalyst can be of a type known in the art, such as those described in U.S. Pat. Nos. 4,224,121 and 3,134,697, and published UK Patent Application No. GB 2,009,788A. Preferred cathodic electrocatalysts include platinum black, Raney nickel and ruthenium black. Preferred anodic electrocatalysts include platinum black and mixed ruthenium and iridium oxides.

The membranes described herein can also be modified on either surface or both surfaces thereof so as to have enhanced gas release properties, for example by providing optimum surface roughness or smoothness, or, preferably, by providing thereon a gas- and liquid-permeable porous non-electrode layer. Such non-electrode layer can be in the form of a thin hydrophilic coating or spacer and is ordinarily of an inert electroinactive or non-electrocatalytic substance. Such non-electrode layer should have a porosity of 10 to 99%, preferably 30 to 70%, and an average pore diameter of 0.01 to 2000 microns, preferably 0.1 to 1000 microns, and a thickness generally in the range of 0.1 to 500 microns, preferably 1 to 300 microns. A non-electrode layer ordinarily comprises an inorganic component and a binder; the inorganic component can be of a type as set forth in published UK Patent Application No. GB 2,064,586A, preferably tin oxide, titanium oxide, zirconium oxide, or an iron oxide such as $Fe_2O_3$ or $Fe_3O_4$. Other information regarding non-electrode layers on ion-exchange membranes is found in published European Patent Application No. 0,031,660, and in Japanese Laid-open Patent Applications Nos. 56-108888 and 56-112487.

The binder component in a non-electrode layer, and in an electrocatalyst composition layer, can be, for example, polytetrafluoroethylene, a fluorocarbon polymer at least the surface of which is hydrophilic by virtue of treatment with ionizing radiation in air or a modifying agent to introduce functional groups such as —COOH or —$SO_3H$ (as described in published UK Patent Application No. GB 2,060,703A) or treatment with an agent such as sodium in liquid ammonia, a functionally substituted fluorocarbon polymer or copolymer which has carboxylate or sulfonate functional groups, or polytetrafluoroethylene particles modified on their surfaces with fluorinated copolymer having acid type functional groups (No. GB 2,064,586A). Such binder is suitably used in an amount of 10 to 50% by wt. of the non-electrode layer or of the electrocatalyst composition layer.

Composite structures having non-electrode layers and/or electrocatalyst composition layers thereon can be made by various techniques known in the art, which include preparation of a decal which is then pressed onto the membrane surface, application of a slurry in a liquid composition (e.g., dispersion or solution) of the binder followed by drying, screen or gravure printing of compositions in paste form, hot pressing of powders distributed on the membrane surface, and other methods as set forth in No. GB 2,064,586A. Such structures can be made by applying the indicated layers onto membranes in melt-fabricable form, and by some of the methods onto membranes in ion-exchange form; the polymeric component of the resulting structures when in melt-fabricable form can be hydrolyzed in known manner to the ion-exchange form.

Non-electrode layers and electrocatalyst composition layers can be used in combination in various ways on a membrane. For example, a surface of a membrane can be modified with a non-electrode layer, and an electrocatalyst composition layer disposed over the latter. It is also possible to place on a membrane a layer containing both an electrocatalyst and a conductive non-electrode material, e.g. a metal powder which has a higher overvoltage than the electrocatalyst, combined into a single layer with a binder. One preferred type of membrane is that which carries a cathodic electrocatalyst composition on one surface thereof, and a non-electrode layer on the opposite surface thereof.

Membranes which carry thereon one or more electrocatalyst layers, or one or more non-electrode layers, or combinations thereof, can be employed in an electrochemical cell in a narrow-gap or zero-gap configuration as described above.

The copolymers used in the layers decribed herein should be of high enough molecular weight to produce films which are at least moderately strong in both the melt-fabricable precursor form and in the hydrolyzed ion exchange form.

To further illustrate the innovative aspects of the present invention, the following examples are provided.

In the examples, abbreviations are used as follows:

PTFE refers to polytetrafluoroethylene;

TFE/EVE refers to a copolymer of tetrafluoroethylene and methyl perfluoro(4,7-dioxa-5-methyl-8-nonenoate);

TFE/PSEPVE refers to a copolymer of tetra-fluoroethylene and perfluoro(3,6-dioxa-4-methyl-7-octenesulfonyl fluoride);

EW refers to equivalent weight.

EXAMPLES

EXAMPLE 1

A reinforced cation exchange membrane was prepared by thermally bonding together the following layers under heat and pressure:

A. A cathode surface layer consisting of a 25-micron (1 mil) film of TFE/EVE having an equivalent weight (EW) of 1080.

B. A 76-micron (3 mil) layer of TFE/PSEPVE having an equivalent weight of 1100.

C. A support fabric containing both reinforcing and sacrificial threads. The reinforcing threads were 200 denier monofilaments of PTFE 19 microns (0.75 mil) thick and 508 microns (20 mils) wide, twisted 3.5 twists er inch and flattened to form thread having a cross-ectional thickness of 38 microns (1.5 mils) and width of 54 microns (10 mils), with a warp and weft thread ount of 7.87 threads/cm (20 threads/inch). The ıreads had an aspect ratio of 6.7. The sacrificial threads vere 50 denier rayon threads with a warp and weft hread count of 15.75 threads/cm (40 threads/inch). The total thickness of the cloth was 76 microns (3 mils).

D. An anode surface layer consisting of 25-micron (1 nil) film of a TFE/PSEPVE copolymer having an equivalent weight of 1100.

The A and B layers were first pressed together without heat, being careful to exclude any air trapped between the layers. The four layers were then passed through a thermal laminator with the D layer supported on a web of porous release paper. In the heated zone a vacuum was applied to the bottom side of the porous release paper which drew any air trapped between the two layers of TFE/PSEPVE through the thin molten bottom layer (the D layer), thereby allowing complete encapsulation of the reinforcing fabric. The temperature of the heated zone was adjusted such that the temperature of the polymer exiting the heated zone was 230°-235° C. as measured by an infrared measuring instrument.

After lamination, the composite membrane was hydrolyzed in an aqueous bath containing 30% dimethylsulfoxide and 11% KOH for 20 minutes at 90° C. The film was then rinsed and mounted wet in a small chloralkali cell having an active area of 45 $cm^2$ between a dimensionally stable anode and a mild steel expanded metal cathode. The cell was operated at 90° C. with a current of 3.1 $KA/m^2$. The anolyte exit salt content was held at 200 g/l. Water was added to the catholyte to maintain the concentration of the caustic produced at 32 ±1%.

After 8 days the cell was performing at 3.55 volts and 97% current efficiency. The performance remained unchanged after 36 days of operation.

EXAMPLE 2

Example 1 was repeated except that the "A" layer consisted of a 50-micron (2 mil) layer of TFE/EVE having an equivalent weight of 1080.

After 8 days of testing in a small chloralkali cell the membrane was performing at 3.65 volts and 97% current efficiency. The performance remained unchanged after 37 days of operation.

EXAMPLE 3

Example 1 was repeated except that the "B" layer consisted of a 101-micron (4 mil) layer of TFE/PSEPVE having an equivalent weight of 1100.

After 8 days of testing in a small chloralkali cell the membrane was performing at 3.65 volts and 97% current efficiency. The performance remained unchanged after 37 days of operation.

EXAMPLE 4

Example 1 was repeated except that the "A" layer consisted of a 50-micron (2 mil) layer of TFE/EVE having an equivalent weight of 1080 and the "B" layer consisted of a 101-micron (4 mil) layer of TFE/PSEPVE having an equivalent weight of 1100.

This membrane was tested in a small chloralkali cell under the same conditions as Example 1 except that the cell temperature was 80° C. After six days of operation the membrane was performing at 3.70 volts and 95.2% current efficiency.

Comparative Example A

This example shows the effect on cell voltage when a reinforcing fabric with monofilaments having a low aspect ratio and without sacrificial threads is used.

A membrane was prepared by thermally bonding together the following layers.

A. A cathode surface layer consisting of a 51-micron (2 mil) layer of TFE/EVE having an equivalent weight of 1080.

B. A 101-micron (4 mil) layer of TFE/PSEPVE having an equivalent weight of 1100.

C. A cloth containing only reinforcing threads with no sacrificial threads. The reinforcing thread consisted of a 200-denier extruded monofilament of a copolymer of 96 wt. % tetrafluoroethylene and 4 wt. % perfluoro(propyl vinyl ether) (see U.S. Pat. No. 4,029,868, Comparison C) having a circular cross section with a diameter of 127 microns (5 mils). This is an aspect ratio of 1. The cloth was a leno weave with a warp thread count of 13.8 threads/cm (34 threads/inch) and a weft thread count of 6.7 threads/cm (17 threads/inch). The cloth was hot calendered so that the total thickness of the cloth was 239 microns (9.4 mils). The threads were slightly flattened at the cross-over points with the thread aspect ratio increased from 1 to 1.13.

D. An anode surface layer consisting of a 51-micron (2 mils) layer of a TFE/PSEPVE copolymer having an equivalent weight of 1100.

This construction was thermally bonded, hydrolyzed, and its performance evaluated as in Example 1.

After 9 days in a small chloralkali cell the membrane was performing at 3.80 volts and 95.2% current efficiency (average of three cell tests).

Attempts to prepare a thinner membrane with the same reinforcing fabric using 25 microns (1 mil) less of either layer A, B or D were unsuccessful because either (1) in attempts at the higher fabrication temperatures the membranes had leaks or (2) in attempts at the lower fabrication temperatures large voids formed between film B and D adjacent the threads of cloth C. Either condition would cause the membrane to be unsuitable for use in a chloralkali cell over a long period of time.

Comparative Example B

This example shows the effect on cell voltage when a reinforcing fabric with monofilaments having a high aspect ratio and without sacrificial threads is used.

The construction was the same as Example A except that the C layer was a reinforcing cloth comprised of 300-denier slit PTFE film monofilament twisted into threads having a thickness of 50.4 microns (2 mils) and a width of 305 microns (12 mils) with a warp and weft thread count of 15.75 threads/cm (40 threads/inch). This is an aspect ratio of 6/1. There were no sacrificial threads.

After 6 days in a small chloralkali cell the membrane was operating at 4.0 volts and 94.5% current efficiency.

EXAMPLE 5

This example illustrates the practice of the invention when a reinforcing fabric with multifilaments having a high aspect ratio together with sacrificial threads is used. The membrane layers were:

A. A 51-micron (2 mils) layer of TFE/EVE of 1050 EW.

B. A 101-micron (4 mils) layer of TFE/PSEPVE of 1100 EW.

C. A cloth containing both reinforcing and sacrificial threads. The reinforcing threads consisted of a 200-denier PTFE multifilament yarn which was calendered or flattened such that the fiber width was 305 microns (12 mils) and the thickness was 56 microns (2.2 mils). This is an aspect ratio of 5.5. There were 5.9 threads/cm (15 threads/inch) in both the warp and weft directions. The sacrificial threads consisted of 50-denier rayon threads with a warp and weft thread count of 23.6 (60 threads/inch). The total thickness of the cloth was 112 microns (4.4 mils).

D. An anode surface layer consisting of 25 microns (1 mil) of a TFE/PSEPVE copolymer having an equivalent weight of 1100.

This construction was thermally bonded, hydrolyzed, and evaluated in a small chloralkali cell as in Example 1, except that the cell temperature was 80° C. After 9 days of operation the current efficiency was 96.7% and the voltage was 3.68 V. After 53 days the values were 95.9% and 3.62 volts.

Comparative Example C

This example shows the effect on cell voltage when a reinforcing fabric having multifilament threads with a high aspect ratio but without being interwoven with a sacrificial fiber is used.

The composition of the laminate was the same as Example 5 except that the reinforcing fabric was as follows:

Layer C was a cloth containing only reinforcing threads without any sacrificial threads. This was a leno weave consisting of paired 200-denier PTFE multifilament warp threads at 20 threads/cm (51 threads/inch) and a 400-denier weft thread at 10.2 threads/cm (26 threads/inch). The fabric was calendered so that the thread width was 508 microns (20 mils) and the thickness was 63.5 microns (2.5 mils) at the thread crossover points. This is an aspect ratio of 8.0. The total thickness of the cloth was 127 microns (5.0 mils).

This construction was thermally bonded and hydrolyzed. Approximately half the area had leaks, indicating that the thickness of the polymer layer was borderline. A leak-free area was evaluated in a small chloralkali cell as in Example 1 except that the cell temperature was 80° C. After 7 days in the cell the membrane was performing at 96.54% current efficiency and 3.99 volts. This is 310 millivolts higher than Example 5 with the sacrificial threads.

EXAMPLE 6

This example illustrates the practice of the invention when a nonwoven reinforcing material containing a blend of fluorocarbon polymer fibers and sacrificial fibers was used.

A. A cathode surface layer consisting of a 51-micron (2 mils) layer of a TFE/EVE copolymer having an equivalent weight of 1080.

B. A 152-micron (6 mil) layer of TFE/PSEPVE having an equivalent weight of 1100.

C. The reinforcing material was a porous paper made from a 50/50 wt. % blend of PTFE filaments 6 mm long and of 6.7 denier, and bleached kraft pulp having a freeness of 630 ml Canadian Standard. The thickness was 119 microns (4.7 mils) and the weight was 33.8 g/m$^2$ (1 oz/yd$^2$).

The laminate was prepared as in Example 1. In the heated zone a vacuum was applied to the bottom side of the porous release paper which drew the molten TFE/PSEPVE down through the porous reinforcing paper thereby allowing complete encapsulation of the reinforcing fabric. The laminate was leak-free after hydrolysis.

The membrane was evaluated in a small chloralkali cell as in Example 1 except that the cell temperature was 80° C. After 7 days of operation the current efficiency was 96% and the voltage was 3.68.

EXAMPLE 7

A laminate was prepared using the same reinforcing materials as the previous example except that a laminator as described in copending application U.S. Ser. No. 121,461 filed Feb. 14, 1980, now U.S. Pat. No. 4,324,606, was used. The layers were:

A. A 51-micron (2 mils) layer of 1080 EW TFE-/EVE.

B. A 51-micron (2 mils) layer of 1100 EW TFE/P-SEPVE.

C. The 50/50 PTFE/kraft as in Example 6.

D. A 51-micron (2 mils) layer of 1100 EW TFE/P-SEPVE.

The laminate was hydrolyzed and evaluated in a small chloralkali cell at a temperature of 80° C. Other conditions were the same as Example 1. After 13 days of operation the current efficiency was 96.5% with a voltage of 3.62.

Comparative Example D

This example shows the effect on cell voltage when a nonwoven reinforcing material containing only TFE filaments without any sacrificial fibers was used.

The construction was similar to Example 6 except that the PTFE paper did not contain any sacrificial fibers. The paper had a thickness of 110 microns (4.3 mils) and basis weight of 110 g/m$^2$ (3.26 g/yd$^2$).

After hydrolysis it was evaluated in a small chloralkali cell where, after 7 days, it showed a current efficiency of 93.1% and a voltage of 4.16.

EXAMPLE 8

A reinforced cation exchange membrane was prepared by thermally bonding together the following layers under heat and pressure;

A. A 51-micron (2 mils) layer of 1080 EW TFE-/EVE.

B. A layer of support fabric as described as item C of Example 1.

C. Another 51-micron (2 mils) layer of 1080 EW TFE/EVE.

The lamination was carried out with the laminator referred to in Example 7, with sufficient heat to heat the film layers to 215°-220° C.

The laminate was hydrolyzed and evaluated in a small chloralkali cell at a temperature of 80° C., with other conditions as specified in Example 1. Over a period of 11 days (day 2 through day 13), 33±1% by wt. caustic was produced at 93.1% current efficiency and 4.20 volts.

EXAMPLE 9

A reinforced cation exchange membrane was prepared by thermally bonding together the following layers:

A. A coextruded film (made in accordance with the disclosure of U.S. application Ser. No. 436,422 filed Oct. 25, 1982) containing two layers of fluoropolymer, a first (cathode surface) layer 38 microns (1.5 mils) thick consisting of TFE/EVE having an EW of 1050, and a second layer 101 microns (4 mils) thick consisting of TFE/PSEPVE having an EW of 1080, with the second layer facing toward the following support fabric.

B. A support fabric containing both reinforcing and sacrificial threads. The reinforcing threads were 200 denier monofilaments of PTFE 19 microns thick and 508 microns wide, twisted 10 twists per inch and flattened, and with a warp and weft count of 5.9 threads/cm (15 threads/in). The twisted threads averaged 43 microns (1.7 mils) in thickness and 178 microns (7 mils) in width for an aspect ratio of 4.1. The sacrificial threads were 40 denier polyethylene terephthalate with a warp and weft count of 23.6 threads/cm (60 threads/in). The total thickness of the cloth was 86 microns (3.4 mils).

C. An anode surface layer consisting of 25-micron (1 mil) film of TFE/PSEPVE copolymer having an EW of 1080.

The three layers were then passed through a thermal laminator with the C layer supported on a web of porous release paper as in Example 1.

After lamination, the composite membrane was hydrolyzed in an aqueous bath as described in Example 1 for 37 minutes at 70° C. The laminate was then rinsed and dried.

Prior to mounting in a cell the membrane was soaked in a 2% sodium hydroxide solution to expand the sheet and prevent subsequent wrinkling in the cell. It was mounted wet in a small laboratory cell having an active area of 45 $cm^2$, between a dimensionally stable anode and a Raney nickel coated activated cathode separated by a gap of 3 mm. The cell was operated at 90° C. with a current density of 3.1 $KA/m^2$. The anolyte exit salt content was held at 200 gpl with the catholyte maintained at 32–33% NaOH.

After 8 days the cell was performing at 3.18 volts and 97% current efficiency. After 255 days of operation it was still operating at 3.25 volts and 96.5% current efficiency.

INDUSTRIAL APPLICABILITY

The ion exchange membrane of the present invention is technically advanced over membranes of the prior art. It exhibits improved performance characteristics when used as membrane in a chloroalkali cell, including operation at low voltage and high current efficiency, and thus at low power consumption. There is accordingly a substantial saving in operating costs resulting from the lowered consumption of power.

We claim:

1. A membrane which is impermeable to hydraulic flow of liquid, which comprises at least two layers of fluorinated polymer which have —COOR or —$S_2W$ functional groups, where R is lower alkyl and W is F or Cl, adjacent said layers being in adherent contact with one another, and a web of support material embedded therein, there being at least a first said layer of polymer whose functional groups are —COOR functional groups and a second said layer of polymer whose functional groups are —COOR or —$SO_2W$ functional groups, each said polymer with —COOR groups having an equivalent weight of 770 to 1250, and any said polymer with —$SO_2W$ groups having an equivalent weight of 900 to 1400, the total thickness of said at least two layers of fluorinated polymer used in preparation of said membrane being in the range of about 50 to 250 microns, said web of support material having a thickness of about 25 to 125 microns and consisting of both reinforcing members and sacrificial members.

2. The membrane of claim 1 wherein said —COOR functional groups are part of —$(CF_2)_t$—COOR moieties where t is 1, 2 or 3, and any said —$SO_2W$ functional groups are part of —$CF_2$—$CF_2$—$SO_2W$ moieties.

3. The membrane of claim 1 wherein said web of support material is a woven fabric whose reinforcing members are perhalocarbon polymer threads which are 50 to 600 denier and have an aspect ratio in the range of 2 to 20, whose sacrificial members are sacrificial threads which are 40 to 100 denier, said woven fabric having a thread count in each of the warp and weft in the range of 1.6 to 16 perhalocarbon polymer threads/cm, and a ratio of sacrificial threads to perhalocarbon polymer threads in each of the warp and weft in the range of 1:1 to 10:1.

4. The membrane of claim 3 wherein said —COOR functional groups are part of —$(CF_2)_t$—COOR moieties where t is 1, 2 or 3, and any said —$SO_2W$ functional groups are part of —$CF_2$—$CF_2$—$SO_2W$ moieties.

5. The membrane of claim 4 wherein said layers are of perfluorinated polymers.

6. The membrane of claim 5 wherein said perhalocarbon polymer threads are perfluorocarbon polymer threads.

7. The membrane of claim 6 wherein there are two layers of said perfluorinated polymer, said second layer being of perfluorinated polymer whose functional groups are —$SO_2W$ groups.

8. The membrane of claim 6 wherein there are two layers of said perfluorinated polymer, said second layer being of perfluorinated polymer whose functional groups are —COOR groups.

9. The membrane of claim 6 wherein said fabric has a thickness of 50 to 100 microns, and said perfluorocarbon polymer threads are of 100 to 300 denier and have an aspect ratio in the range of 4 to 10.

10. The membrane of claim 9 wherein said fabric has a thread count in each of the warp and weft in the range of 3 to 8 perfluorocarbon polymer threads/cm, and a ratio of sacrificial threads to perfluorocarbon polymer threads in each of the warp and weft of 4:1 or 8:1.

11. The membrane of claim 10 wherein said perfluorocarbon polymer threads are monofilament of polytetrafluoroethylene.

12. The membrane of claim 11 wherein said perfluorocarbon polymer threads have a substantially rectangular cross section, an aspect ratio in the range of 4 to 8, and a thickness of about 35 to 40 microns, and the ratio of sacrificial threads to perfluorocarbon polymer threads in each of the warp and weft is 4:1.

13. The membrane of claim 10 wherein each said perfluorocarbon polymer thread is multistranded.

14. The membrane of claim 10 wherein there are two layers of fluorinated polymer, said first layer having a thickness in the range of 13 to 75 microns, said second layer having a thickness in the range of 50 to 125 microns, and said total thickness of said layers of fluorinated polymer being in the range of 75 to 150 microns.

15. The membrane of claim 7, 8, 11, 12, 13 or 14 wherein said —COOR functional groups are part of —O—$(CF_2)_t$—COOR moieties.

16. The membrane of claim 7, 8, 11, 12, 13 or 14 wherein t is 2 and any said —$SO_2W$ functional groups are part of —O—$CF_2$—$CF_2$—$SO_2W$ moieties.

17. The membrane of claim 7, 8, 11, 12, 13 or 14 wherein said woven fabric lies at least predominantly in said second layer of perfluorinated polymer.

18. The membrane of claim 7, 8, 11, 12, 13 or 14 wherein said sacrificial threads are polyester, polyamide or cellulosic threads.

19. The membrane of claim 1 wherein said web of support material is a nonwoven paper whose reinforcing members are 10 to 90% by wt. of perhalocarbon polymer fibers and whose sacrificial members are 90 to 10% by wt. of sacrificial fibers, said paper having a basis weight of about 25 to 125 g/$m^2$.

20. The membrane of claim 19 wherein said —COOR functional groups are part of —$(CF_2)_t$—COOR moieties where t is 1, 2 or 3, and any said —$SO_2W$ functional groups are part of —$CF_2$—$CF_2$—$SO_2W$ moieties.

21. The membrane of claim 19 wherein said layers are of perfluorinated polymers.

22. The membrane of claim 21 wherein said perhalocarbon polymer fibers are perfluorocarbon polymer fibers.

23. The membrane of claim 22 wherein there are two layers of said perfluorinated polymer, said second layer being of perfluorinated polymer whose functional groups are —$SO_2W$ groups.

24. The membrane of claim 22 wherein there are two layers of said perfluorinated polymer, said second layer being of perfluorinated polymer whose functional groups are —COOR groups.

25. The membrane of claim 22 wherein said nonwoven paper has a thickness of 50 to 75 microns and a basis weight of 25 to 50 g/$m^2$.

26. The membrane of claim 25 wherein said perfluorocarbon polymer fibers are 5 to 10 denier and have a length of 3 to 20 mm.

27. The membrane of claim 26 wherein said sacrificial fibers are cellulosic kraft fibers having a freeness in the range of 500 to 700 ml Canadian Standard.

28. The membrane of claim 27 wherein said nonwoven paper consists of 25 to 75% by wt. of said perfluorocarbon polymer fibers and 75 to 25% by wt. of said kraft fibers.

29. The membrane of claim 27 wherein there are two layers of fluorinated polymer, said first layer having a thickness in the range of 13 to 75 microns, said second layer having a thickness in the range of 50 to 125 microns, and said total thickness of said layers of fluorinated polymer being in the range of 75 to 150 microns.

30. The membrane of claim 23, 24, 28 or 29 wherein said —COOR functional groups are part of —O—$(CF_2)_t$—COOR moieties.

31. The membrane of claim 23, 24, 28 or 29 wherein t is 2 and any said —$SO_2W$ functional groups are part of —O—$CF_2$—$CF_2$—$SO_2W$ moieties.

32. The membrane of claim 23, 24, 28 or 29 wherein said nonwoven paper lies at least predominantly in said second layer of perfluorinated polymer.

33. The membrane of claim 1 wherein said membrane further comprises a gas- and liquid-permeable porous layer of electrocatalyst composition on at least one surface thereof.

34. The membrane of claim 1 wherein said membrane further comprises a gas- and liquid-permeable porous non-electrode layer on at least one surface thereof.

35. An ion exchange membrane which is impermeable to hydraulic flow of liquid, which comprises at least two layers of fluorinated polymer having —COOM or —$SO_3M$ functional groups, where M is H, Na, K or $NH_4$, adjacent said layers being in adherent contact with one another, and a web of support material embedded therein, there being at least a first said layer of polymer whose functional groups are —COOM functional groups and a second said layer of polymer whose functional groups are —COOM or —$SO_3M$ functional groups, each said polymer with —COOM groups having an equivalent weight of 770 to 1250, and any said polymer with —$SO_3M$ groups having an equivalent weight of 900 to 1400, the total thickness of said at least two layers of fluorinated polymer, as measured on the layers of precursor polymer having —COOR or —$SO_2W$ functional groups where R is lower alkyl and W is F or Cl used in preparation of said membrane, being in the range of 50 to 250 microns, said web of support material having a thickness of about 25 to 125 microns and an openness of at least 50% and consisting of reinforcing members, said reinforcing members defining window areas therebetween, and channels in said membrane extending from said window areas to blind areas where said reinforcing members are proximate to said first layer.

36. The membrane of claim 35 wherein said channels are open to the exposed surface of said second layer.

37. The membrane of claim 35 wherein said —COOM functional groups are part of —$(CF_2)_t$—COOM moieties where t is 1, 2 or 3, and any said —$SO_3M$ functional groups are part of —$CF_2$—$CF_2$—$SO_3M$ moieties.

38. The membrane of claim 35 wherein said web of support material is a fabric whose reinforcing members are perhalocarbon polymer threads which are 50 to 600 denier and have an aspect ratio in the range of 2 to 20, said fabric having a thread count in each of the warp and weft in the range of 1.6 to 16 perhalocarbon polymer threads/cm, said threads in the warp meeting said threads in the weft at junctions, each adjacent pair of junctions defining a thread segment, there being at least one said channel extending from a window area to said blind areas adjacent at least half of said thread segments.

39. The membrane of claim 38 wherein said —COOM functional groups are part of —$(CF_2)_t$—COOM moieties where t is 1, 2 or 3, and any said —$SO_3M$ functional groups are part of —$CF_2$—$CF_2$—$SO_3M$ moieties.

40. The membrane of claim 39 wherein there is at least one said channel extending from a window area to said blind areas adjacent all of said thread segments.

41. The membrane of claim 40 wherein said layers are of perfluorinated polymers.

42. The membrane of claim 41 wherein said perhalocarbon polymer threads are perfluorocarbon polymer threads.

43. The membrane of claim 42 wherein there are two layers of said perfluorinated polymer, said second layer being of perfluorinated polymer whose functional groups are —$SO_3M$ groups.

44. The membrane of claim 42 wherein there are two layers of said perfluorinated polymer, said second layer being of perfluorinated polymer whose functional groups are —COOM groups.

45. The membrane of claim 42 wherein said fabric has a thickness of 50 to 100 microns, and said perfluorocarbon polymer threads are of 100 to 300 denier and have an aspect ratio in the range of 4 to 10.

46. The membrane of claim 45 wherein said fabric has a thread count in each of the warp and weft in the range of 3 to 8 perfluorocarbon polymer threads/cm.

47. The membrane of claim 46 wherein said perfluorocarbon polymer threads are monofilament of polytetrafluoroethylene.

48. The membrane of claim 47 wherein said perfluorocarbon polymer threads have a substantially rectangular cross section, an aspect ratio in the range of 4 to 8, and a thickness of about 35 to 40 microns.

49. The membrane of claim 46 wherein each said perfluorocarbon polymer thread is multistranded.

50. The membrane of claim 46 wherein there are two layers of said perfluorinated polymer, said —COOM groups are part of $—O—(CF_2)_t—COOM$ moieties, said first layer having a thickness in the range of 13 to 75 microns, said second layer having a thickness in the range of 50 to 125 microns, and said total thickness of said layers of fluorinated polymer being in the range of 75 to 150 microns.

51. The membrane of claim 50 wherein said channels are open to the exposed surface of said second layer.

52. The membrane of claim 46 wherein said channels have a nominal diameter of 10 to 50 microns.

53. The membrane of claim 43, 44, 47, 48, 49 or 50 wherein said —COOR functional groups are part of $—O—(CF_2)_t—COOR$ moieties.

54. The membrane of claim 43, 44, 47, 48, 49 or 50 wherein t is 2 and any said $—SO_3M$ functional groups are part of $—O—CF_2—CF_2—SO_3M$ moieties.

55. The membrane of claim 43, 44, 47, 48, 49 or 50 wherein said fabric lies at least predominantly in said second layer of fluorinated polymer.

56. The membrane of claim 35 wherein said web of support material is a nonwoven paper whose reinforcing members are perhalocarbon polymer fibers and which has a basis weight of 2.5 to 112.5 $g/m^2$.

57. The membrane of claim 56 wherein said —COOM functional groups are part of $—(CF_2)_t—COOM$ moieties where t is 1, 2 or 3, and any said $—SO_3M$ functional groups are part of $—CF_2—CF_2—SO_3M$ moieties.

58. The membrane of claim 57 wherein said layers are of perfluorinated polymers.

59. The membrane of claim 58 wherein said perhalocarbon polymer fibers are perfluorocarbon polymer fibers.

60. The membrane of claim 59 wherein there are two layers of said perfluorinated polymer, said second layer being of perfluorinated polymer whose functional groups are $—SO_3M$ groups.

61. The membrane of claim 59 wherein there are two layers of said perfluorinated polymer, said second layer being of perfluorinated polymer whose functional groups are —COOM groups.

62. The membrane of claim 59 wherein said nonwoven paper has a thickness of 50 to 75 microns and a basis weight of 2.5 to 45 $g/m^2$.

63. The membrane of claim 60 wherein said perfluorocarbon polymer fibers are 5 to 10 denier and have a length of 3 to 20 mm.

64. The membrane of claim 60 wherein there are two layers of said perfluorinated polymer, said —COOM groups are part of $—O—(CF_2)_t—COOM$ moieties, said first layer having a thickness in the range of 13 to 75 microns, said second layer having a thickness in the range of 50 to 125 microns, and said total thickness of said layers of fluorinated polymer being in the range of 75 to 150 microns.

65. The membrane of claim 61 wherein said channels have nominal diameters of 1 to 20 microns.

66. The membrane of claim 60, 61, 64 or 65 wherein said —COOR functional groups are part of $—O—(CF_2)_t—COOR$ moieties.

67. The membrane of claim 60, 61, 64 or 65 wherein t is 2 and any said $—SO_3M$ functional groups are part of $—O—CF_2—CF_2—SO_3M$ moieties.

68. The membrane of claim 60, 61, 64 or 65 wherein said nonwoven paper lies at least predominantly in said second layer of perfluorinated polymer.

69. The membrane of claim 35 wherein said membrane further comprises a gas- and liquid-permeable porous layer of electrocatalyst composition on at least one surface thereof.

70. The membrane of claim 35 wherein said membrane further comprises a gas- and liquid-permeable porous non-electrode layer on at least one surface thereof.

71. The membrane of claim 50 wherein said membrane further comprises a gas- and liquid-permeable porous layer of cathodic electrocatalyst composition on the exposed surface of said first layer, and a gas- and liquid-permeable porous non-electrode layer on the exposed surface of said second layer.

72. An electrochemical cell which comprises an anode compartment, an anode situated within said anode compartment, a cathode compartment, a cathode situated within said cathode compartment, and, between said compartments, said membrane of claim 35, 38, 43, 44, 48, 50, 56, 64, 59 or 70.

73. The electrochemical cell of claim 72 wherein the spacing between said anode and said cathode is no greater than about 3 mm.

74. The electrochemical cell of claim 73 wherein said membrane is in contact with at least one of said anode and said cathode.

75. The electrochemical cell of claim 74 wherein said membrane is in contact with both said anode and said cathode.

76. In a process for electrolysis of brine in a chloralkali cell which comprises an anode, an anode compartment, a cathode, a cathode compartment, and a fluorine-containing cation exchange membrane which separates said compartments, to form caustic and chlorine, the improvement which comprises employing as said membrane the membrane of claim 35, 38, 43, 44, 48, 50, 56, 64, 59 or 70.

77. The process of claim 76 wherein the spacing between said anode and said cathode is no greater than about 3 mm.

78. The process of claim 77 wherein said membrane is in contact with at least one of said anode and said cathode.

79. The process of claim 78 wherein said membrane is in contact with both said anode and said cathode.

80. The membrane of claim 18 wherein said sacrificial threads are cellulosic threads.

81. The membrane of claim 18 wherein said sacrificial threads are polyester threads.

82. The membrane of claim 81 wherein said membrane comprises a gas- and liquid-permeable porous non-electrode layer on at least one surface thereof.

* * * * *